US010029359B2

(12) United States Patent
Papp

(10) Patent No.: US 10,029,359 B2
(45) Date of Patent: Jul. 24, 2018

(54) PORTABLE POWER TOOL

(71) Applicant: Robert Bosch GmbH, Stuttgart (DE)

(72) Inventor: Gabor Papp, Miskolc (HU)

(73) Assignee: Robert Bosch GmbH, Stuttgart (DE)

( * ) Notice: Subject to any disclaimer, the term of this patent is extended or adjusted under 35 U.S.C. 154(b) by 723 days.

(21) Appl. No.: 14/534,671

(22) Filed: Nov. 6, 2014

(65) Prior Publication Data

US 2015/0122524 A1 May 7, 2015

(30) Foreign Application Priority Data

Nov. 6, 2013 (DE) ..... 10 2013 222 550

(51) Int. Cl.
*B25B 21/00* (2006.01)
*B25F 5/00* (2006.01)
*B25F 5/02* (2006.01)

(52) U.S. Cl.
CPC ..... *B25F 5/001* (2013.01); *B25B 21/00* (2013.01); *B25F 5/02* (2013.01)

(58) Field of Classification Search
CPC ..... B25F 5/001; B25F 5/02; B25B 21/00
USPC ..... 173/20, 213, 216, 21, 47, 178, 11
See application file for complete search history.

(56) References Cited

U.S. PATENT DOCUMENTS 3,785,443 A * 1/1974 Armbruster ..... B23B 45/008 173/117
6,093,130 A * 7/2000 Buck ..... B25F 5/001 173/216
6,142,243 A * 11/2000 Mayer ..... B25B 23/14 173/176
7,201,235 B2 * 4/2007 Umemura ..... B23B 45/008 173/104
7,602,137 B2 * 10/2009 Du ..... H02K 1/278 318/771
8,251,158 B2 * 8/2012 Tomayko ..... B23B 45/008 173/11
8,746,364 B2 * 6/2014 Atsumi ..... B25B 21/008 173/176
2006/0086514 A1 4/2006 Aeberhard
2006/0213675 A1 * 9/2006 Whitmire ..... B23B 45/008 173/48

(Continued)

FOREIGN PATENT DOCUMENTS

CN 1579712 A 2/2005
CN 101443161 A 5/2009

(Continued)

*Primary Examiner* — Hemant M Desai
*Assistant Examiner* — Eduardo R Ferrero
(74) *Attorney, Agent, or Firm* — Maginot, Moore & Beck LLP

(57) ABSTRACT

A portable power tool includes a drive motor configured to generate torque, a transmission including a plurality of transmission gears positioned in a housing and configured to transmit torque generated by the drive motor to a drive shaft, a first adjusting element positioned on the housing, and a first sensor configured to detect a position of the first adjusting element. The first adjusting element is configured to set at least one of the torque and a transmission gear of the plurality of transmission gears. The first sensor is configured to transmit a first signal corresponding to the position of the first adjusting element to an electronic control element.

17 Claims, 7 Drawing Sheets

(56) References Cited

U.S. PATENT DOCUMENTS

2006/0237205 A1* 10/2006 Sia ..... B25B 21/00 173/48
2007/0151114 A1* 7/2007 Papp ..... B27C 1/10 30/475
2007/0181319 A1* 8/2007 Whitmine ..... B25B 21/00 173/48
2009/0101376 A1* 4/2009 Walker ..... B25B 21/00 173/47
2010/0163261 A1* 7/2010 Tomayko ..... B23B 45/008 173/47
2010/0175902 A1* 7/2010 Rejman ..... B25D 16/006 173/1
2010/0193207 A1* 8/2010 Mok ..... B23B 31/1238 173/48
2011/0220377 A1* 9/2011 Roehm ..... B25B 21/00 173/47
2011/0232933 A1* 9/2011 Kondo ..... B25B 21/00 173/217
2012/0010043 A1* 1/2012 Inagaki ..... B23B 45/008 477/20
2012/0061116 A1* 3/2012 Aoki ..... B23D 47/12 173/178
2012/0090863 A1* 4/2012 Puzio ..... B25B 21/02 173/2
2012/0160529 A1* 6/2012 Eshleman ..... B25B 21/00 173/1
2012/0289377 A1* 11/2012 Aoki ..... B25D 16/003 477/107
2012/0322605 A1* 12/2012 Hirabayashi ..... B25B 21/008 475/149
2013/0025899 A1* 1/2013 Kuehne ..... B25F 5/001 173/216
2013/0033217 A1* 2/2013 Hirabayashi ..... B23B 45/008 318/546
2013/0126202 A1* 5/2013 Oomori ..... B25B 21/00 173/217
2013/0161048 A1* 6/2013 Hirabayashi ..... B25F 5/001 173/176
2013/0206435 A1* 8/2013 Papp ..... B25B 21/00 173/20
2013/0220655 A1* 8/2013 Tomayko ..... B25F 5/001 173/47
2013/0233584 A1* 9/2013 Mashiko ..... B25B 21/00 173/181
2013/0237367 A1* 9/2013 Roehm ..... B23B 45/008 475/290
2013/0240230 A1* 9/2013 Saur ..... B25B 21/00 173/178
2013/0255981 A1* 10/2013 Noto ..... B25F 5/001 173/20
2013/0255982 A1* 10/2013 Takahashi ..... B25B 21/02 173/47
2013/0267374 A1* 10/2013 Blum ..... F16H 3/44 475/299
2013/0269961 A1* 10/2013 Lim ..... B25F 5/001 173/1
2013/0284475 A1* 10/2013 Hirabayashi ..... B25F 5/008 173/47
2013/0284477 A1* 10/2013 Braun ..... B23Q 5/58 173/176
2013/0327552 A1* 12/2013 Lovelass ..... B25F 5/00 173/1
2014/0166324 A1* 6/2014 Puzio ..... H01H 9/06 173/20
2014/0329654 A1* 11/2014 Andriolo ..... B25F 5/029 483/1
2014/0371018 A1* 12/2014 Ito ..... B25F 5/008 475/149
2015/0273671 A1* 10/2015 Totsu ..... B25B 21/00 173/178
2016/0193673 A1* 7/2016 Yoshida ..... B23D 47/12 30/388
2016/0199972 A1* 7/2016 Kishima ..... B23B 45/02 173/46
2016/0354912 A1* 12/2016 Bartoszek ..... B25F 5/001
2016/0354913 A1* 12/2016 Madineni ..... B25F 5/001
2016/0354914 A1* 12/2016 Bartoszek ..... B25F 5/001
2017/0036337 A1* 2/2017 Sawano ..... B23B 45/008
2017/0047819 A1* 2/2017 Forster ..... B25F 5/00

FOREIGN PATENT DOCUMENTS

CN 101797744 A 8/2010
CN 201783922 U 4/2011
CN 102310397 A 1/2012
CN 102892555 A 1/2013
CN 103286727 A 9/2013
WO WO2011147641 * 12/2011

* cited by examiner

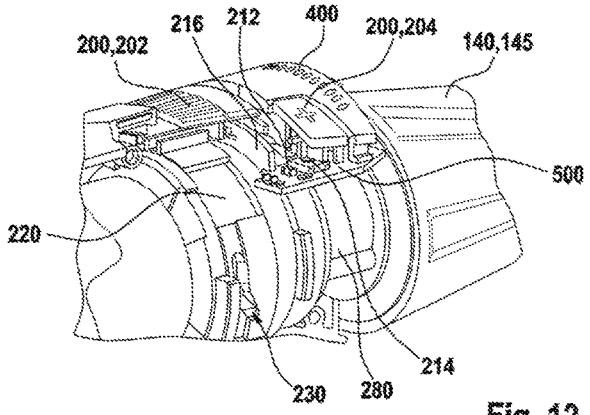
Fig. 12
Fig. 13
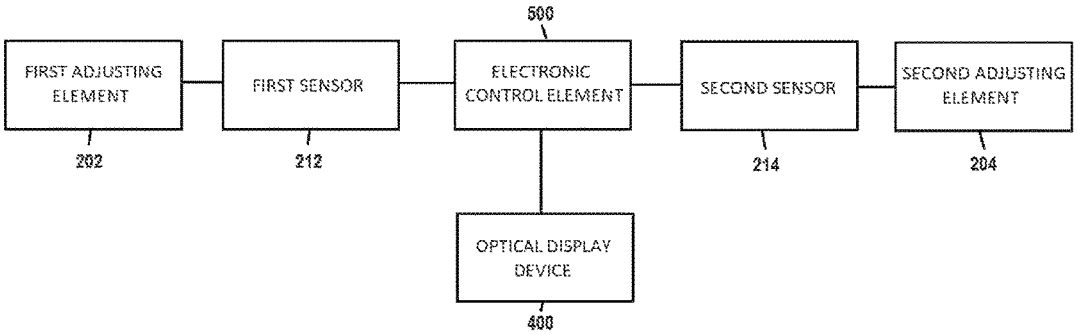

PORTABLE POWER TOOL

This application claims priority under 35 U.S.C. § 119 to patent application no. DE 10 2013 222 550.4, filed on Nov. 6, 2013 in Germany, the disclosure of which is incorporated herein by reference in its entirety.

The present disclosure relates to a portable power tool, in particular a straight screwdriver, a drill driver or a cordless drill driver having a tool carrier that is settable in rotation and is drivable by a drive motor via a transmission.

BACKGROUND

Portable power tools having a transmission, for example a cordless drill driver or a drilling machine, generally have a safety coupling such that the portable power tool does not continue to rotate in an uncontrolled manner if a predefined torque is exceeded. Furthermore, it is known that such portable power tools have actuating elements, by means of which the torque to be transmitted can be set and thus it is possible to choose between different operating modes. Thus, for example, US 2011/0232933 discloses an electric tool having a tool carrier that is settable in rotation, wherein the tool carrier is drivable by a drive motor via a transmission. The known electric tool has in this case an adjusting device, by means of which it is possible to switch between a number of operating modes. Moreover, depending on the position, in addition to the operating mode the rotational speed can also be set, wherein automatic operation with a variable rotational speed is provided. The operating modes are in this case set manually, wherein the different parameters can only be adapted or readjusted manually during the work operation.

SUMMARY

An object of the disclosure is to improve the abovementioned disadvantages and to provide a portable power tool which allows easy, safe and flexible setting of the operating modes and in the process has the simplest possible construction and is cost-effective.

This object is achieved by a portable power tool. Advantageous configurations, variants and developments of the disclosure can be gathered from the specification, drawings and claims.

The disclosure includes a portable power tool comprising a transmission having a plurality of transmission gears in a housing, in particular a planetary transmission, for transmitting a torque generated by a drive motor to a drive shaft, at least one adjusting element provided on the housing, in particular for setting the torque and/or a transmission gear of the transmission, characterized in that provision is made of at least one first sensor which detects a position of the at least one adjusting element and transmits a signal corresponding to this position to an electronic control means of the portable power tool. As a result, compared with the prior art, provision is made of a portable power tool which allows safe, easy and user-friendly operation. In this case, it is advantageous for the electronic control to be able to take place from the inside via a microcontroller contained in the housing, said microcontroller evaluating the transmitted signals from the sensor.

Accordingly, in one design embodiment of the disclosure, it is proposed that, depending on the corresponding signal, the control means activates an operating state on the portable power tool with a combination of predefined parameters, with the result that it is possible to ensure that the portable power tool always runs in an operating state that is adapted to the situation and is thus optimal.

In a particularly preferred configuration of the disclosure, a first sensor senses the position of a first adjusting element and a second sensor senses the position of a second adjusting element, wherein the first sensor and the second sensor each transmit a corresponding signal to the electronic control means of the portable power tool and, depending on the corresponding signals, the control means activates an operating state on the portable power tool with a combination of predefined parameters. In this way, it is possible to ensure that, based on the position of the adjusting elements, optimal setting of the parameters takes place and thus the portable power tool can be used in an optimal operating state, while a portable power tool according to the disclosure is individual, safe, easy and above all user-friendly to utilize.

Preferably, the adjusting element is configured in the form of a switch that is directly actuated mechanically, in particular in the form of a slide switch, a pressure switch and/or a switch actuated via sensors, wherein in a particularly preferred embodiment, the adjusting element is a slide switch which can be displaced in the circumferential direction of the housing. In this way, high robustness of the portable power tool, in particular of the adjusting element, can be ensured.

It has been found to be advantageous for provision to be made of an adjusting ring, wherein the adjusting ring is arranged so as to be displaceable in the radial direction beneath the adjusting element and in the circumferential direction of the housing. In this case, the adjusting ring is advantageously connected to the adjusting element via a coupling element such that a movement of the adjusting element is transmitted to the adjusting ring.

In a particularly preferred embodiment, the adjusting ring has at least one channel in the circumferential direction, wherein, in an advantageous embodiment, the channel extends obliquely to the circumferential direction in a first portion and in the circumferential direction in a second portion.

According to one embodiment of the disclosure, at least one actuator that is arranged so as to be displaceable only in the axial direction of the portable power tool is connected to the transmission housing, wherein the actuator engages in the channel of the adjusting ring via at least one connecting element.

Preferably, a rotational movement of the adjusting ring in the circumferential direction brings about an axial movement of the actuator when the connecting element is located in the region of the first portion, and in that a rotational movement of the adjusting ring in the circumferential direction does not bring about any movement of the actuator at all when the connecting element is located in the region of the second portion.

In a preferred embodiment, the transmission housing has at least one first guide means in the circumferential direction and the adjusting ring has at least one second guide means in the circumferential direction, wherein the second guide means interacts with at least the first guide means such that a rotational movement of the adjusting ring in the circumferential direction brings about an axial movement of the actuator.

In a particularly advantageous configuration, the transmission furthermore has a flange, wherein the flange comprises at least one third guide means in the circumferential direction, wherein the third guide means interacts with the second and/or with the first guide means such that a rotational movement of the adjusting ring in the circumferential direction brings about an axial movement of the actuator.

Advantageously, the transmission has at least one ring gear, wherein the ring gear is connected to the actuator in the axial direction by connecting means in such a form-fitting manner that a displacement of the actuator in the axial direction causes an axial movement of the ring gear. In this case, the axial movement of the ring gear causes engagement of the transmission in at least two different speed stages. In this case, it is particularly advantageous for the ring gear to be connected to the actuator in a form-fitting manner in the axial direction by connecting means.

In particular, provision is made of at least one spring element, wherein the spring element holds the adjusting element in the different positions.

Furthermore, it has been found to be advantageous for provision to be made of at least one optical display device, in particular a binary display, a numeric display, or an analog display, wherein, in a particular embodiment of the disclosure, the at least one display device displays the position, sensed by the sensors, of the adjusting element and/or the operating state, activated by the control means, of the portable power tool, such that a user can quickly register the operating state and if necessary make alterations.

In a preferred embodiment, the portable power tool is a cordless drill driver, a drilling machine, a percussion drilling machine or a hammer drill, wherein a drill bit, core bit or various bit attachments can be used as the tool.

A portable power tool should be understood as meaning generally all portable power tools having a tool carrier which is settable in rotation and is driveable by a drive motor via a planetary transmission, for example straight screwdrivers, cordless drills, percussion drilling machines, multifunctional tools and/or drill drivers. The transmission of electrical energy should in this connection be understood as meaning in particular that the portable power tool passes on energy to the body via a rechargeable battery and/or a power cable connection.

Further features, possible applications and advantages of the disclosure can be gathered from the following description of an exemplary embodiment of the disclosure, said exemplary embodiment being illustrated in the drawings. In this case, it should be noted that the features described or illustrated in the figures, individually or in any desired combination, have only a descriptive character the subject matter of the disclosure, regardless of their summary in the claims or the back-references therein, and regardless of their formulation and illustration in the description and in the drawings, respectively, and are not intended to limit the disclosure in any form.

BRIEF DESCRIPTION OF THE DRAWINGS

FIG. 12 shows a perspective schematic, partially sectional view of the portable power tool in the region of the setting unit; and FIG. 13 shows a schematic view of an electronic control element operably connected to sensors, adjusting elements, and a display device.

DETAILED DESCRIPTION

Figure 1:
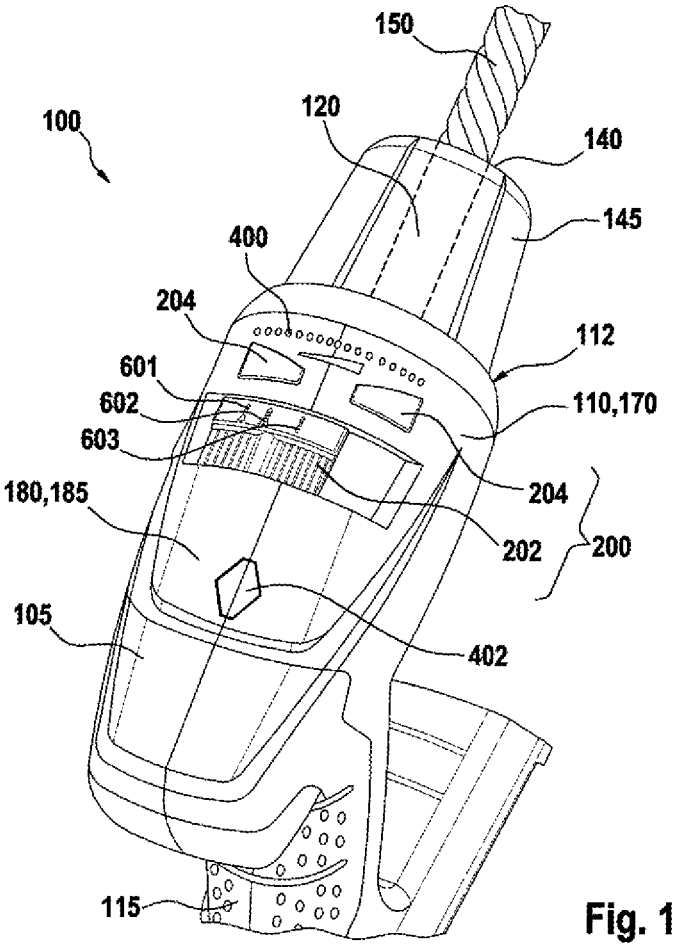
FIG. 1 shows a perspective schematic view of part of a portable power tool according to the disclosure in the form of a cordless drill driver.
Figure 2:
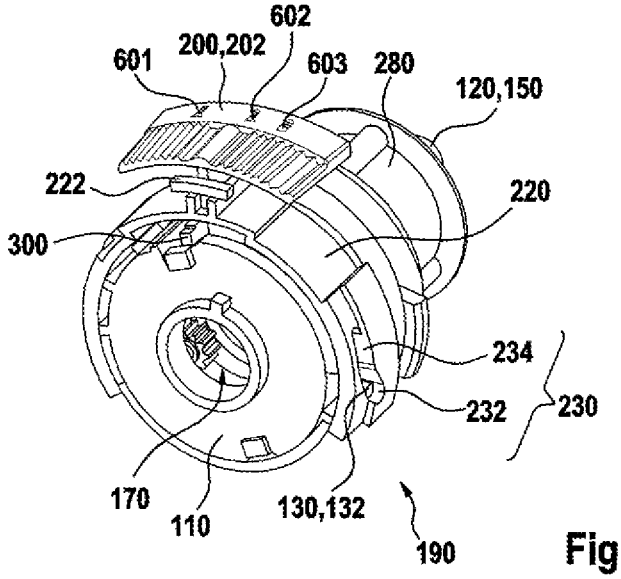
FIG. 2 shows a perspective schematic view of a first variant of a setting unit of a portable power tool according to the disclosure.

FIG. 1 shows a portable power tool 100 according to the disclosure, which has a housing 105 with a handgrip 115. According to the embodiment illustrated, in order to supply power independently of the mains power supply, the portable power tool 100 is connectable mechanically and electrically to a battery pack (not illustrated). In FIG. 1, the portable power tool 100 is in the form for example of a cordless drill driver. However, it should be noted that the present disclosure is not limited to cordless drill drivers but rather can be utilized in different portable power tools in which a tool is set into rotation, for example in a cordless drill, a cordless percussion drilling machine or a straight screwdriver or a percussion drilling machine.

Arranged in the housing 105 are an electric drive motor 180 that is supplied with power, and a transmission 170. The drive motor 180 is connected to a drive shaft 120 via the transmission 170. The drive motor 180 is illustratively arranged in a motor housing 185 and the transmission 170 in a transmission housing 110, wherein the transmission housing 110 and the motor housing 185 are arranged by way of example in the housing 105.

The drive motor 180 is actuable, i.e. able to be switched on and off, for example via a hand switch, and can be any desired motor type, for example an electronically commutated motor or a DC motor. Preferably, the drive motor 180 is electronically controllable or regulatable such that both reversing operation and parameters with regard to a desired rotation speed are realizable. The functioning and the construction of a suitable drive motor are well known from the prior art and so a detailed description is dispensed with here in order to keep the description concise.

The drive shaft 120 is mounted rotatably in the housing 105 via a bearing arrangement and provided with a tool receptacle 140 which is arranged in the region of an end side 112 of the housing 105 and has for example a drill chuck 145. The tool receptacle 140 serves to receive a tool 150 and can be integrally formed on the drive shaft 120 or connected to the latter in the form of an attachment.

Furthermore, the portable power tool has a first adjusting element 202 which serves for setting a transmission gear of the transmission 170, and a second adjusting element 204 which serves to set the torque. The first adjusting element 202 is configured as a slide switch 202 in the form of a rotary ring, which is arranged on the housing 105 so as to be displaceable preferably in a stepless manner within a particular rotary angle range in the circumferential direction. The second adjusting element 204 is configured as a pressure switch. Alternatively, the adjusting elements could each also be configured as rotary switches, pressure switches or slide switches.

As is discernible in FIGS. 2 to 8, the transmission 170 is, according to one embodiment, a planetary transmission 100 formed with different gear or planet stages, a torque clutch being assigned to said planetary transmission 100. During operation of the portable power tool 100, the planetary transmission 170 is driven in rotation by the drive motor 180. Wherein it should be noted at this point that the construction and the operation of a planetary transmission and the interaction with the illustrated clutch for setting a torque are well known, and so no further details shall be provided therefor in the context of the present description.

FIGS. 2 to 7 illustrate a first variant of a setting unit, in which an adjusting ring 220 is provided in a manner arranged so as to be displaceable in the radial direction beneath the adjusting element 200 and in the circumferential direction of the housing 110. This adjusting ring 220 is connected to the adjusting element 200, or the slide switch 202, via a coupling element 222 such that a movement of the adjusting element 200 is transmissible to the adjusting ring 220. The adjusting ring 200 has at least two channels 230 in the circumferential direction, wherein the channels 230 are subdivided into a first portion 232 which extends obliquely with respect to the circumferential direction, and into a second portion 234 which extends in the circumferential direction.

Figure 3:
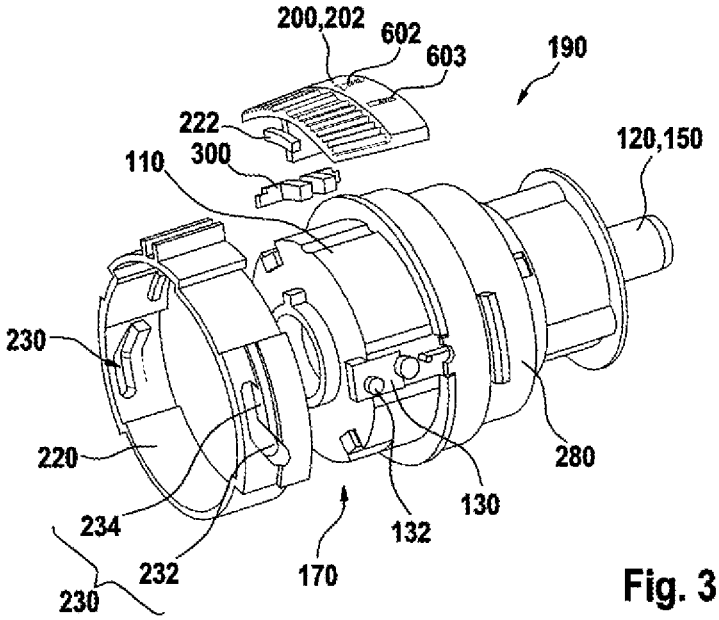
FIG. 3 shows a partially exploded, perspective schematic view of the setting unit from FIG. 2.
Figure 4:
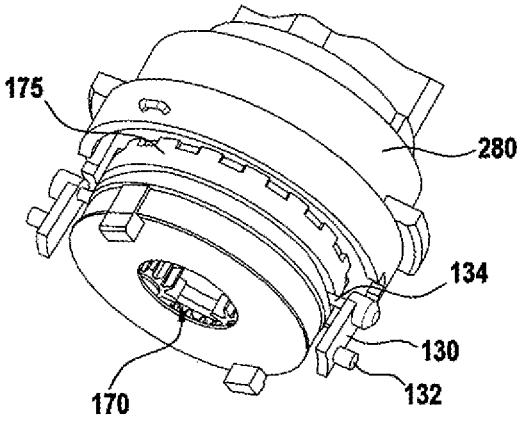
FIG. 4 shows a perspective schematic view of a portion of the setting unit in FIGS. 2 and 3.
Figure 5:
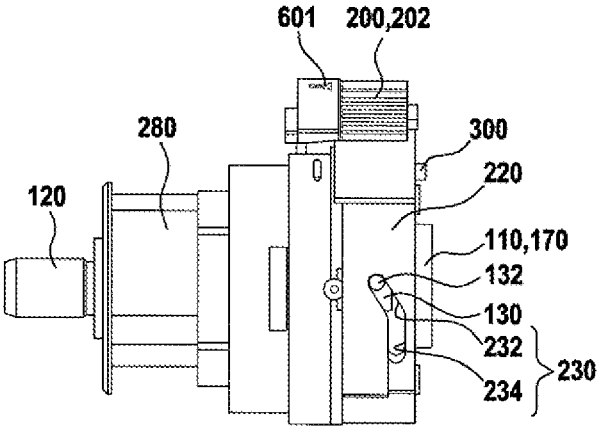
FIG. 5 shows a schematic sectional view of the setting unit from FIGS. 2 to 4 with connecting elements in the region of a first portion.
Figure 6:
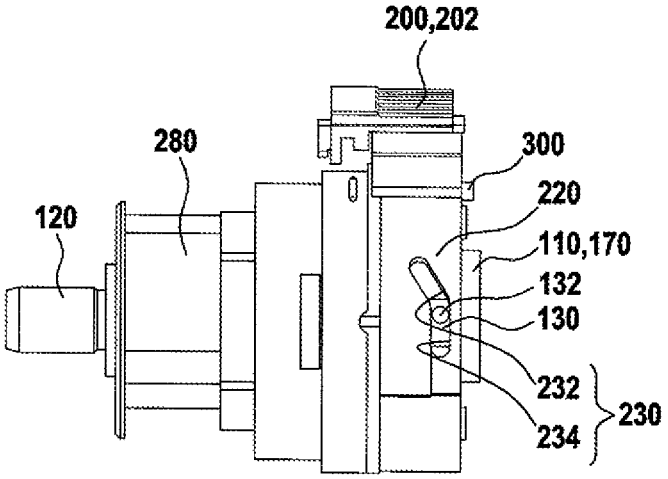
FIG. 6 shows a schematic sectional view of the setting unit from FIGS. 2 to 5 with connecting elements in the region of a second portion.
Figure 7:
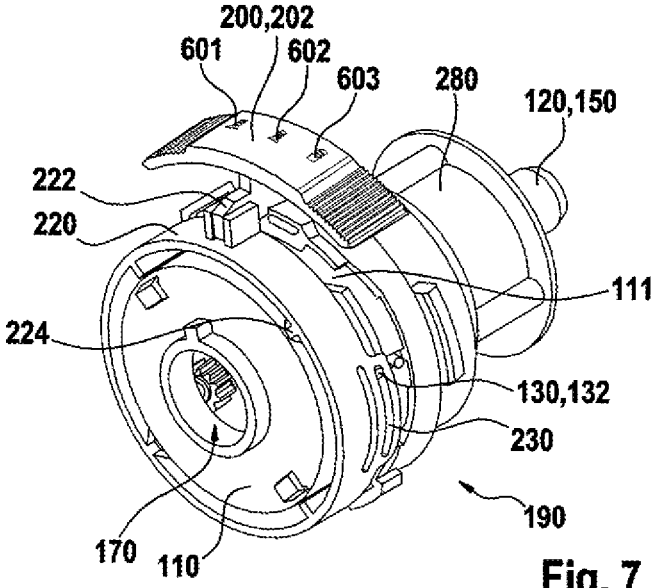
FIG. 7 shows a perspective schematic view of a second variant of a setting unit of a portable power tool according to the disclosure.
Figure 8:
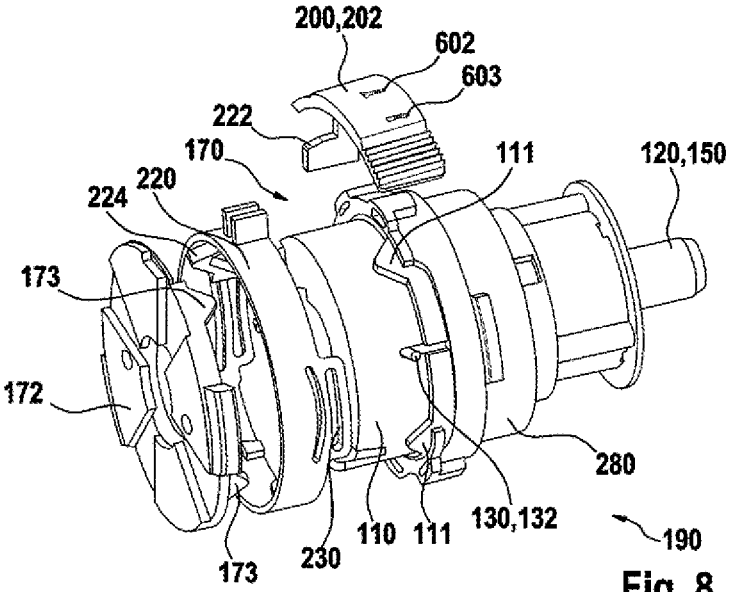
FIG. 8 shows a partially exploded, perspective schematic view of the setting unit from FIG. 7.
Figure 9:
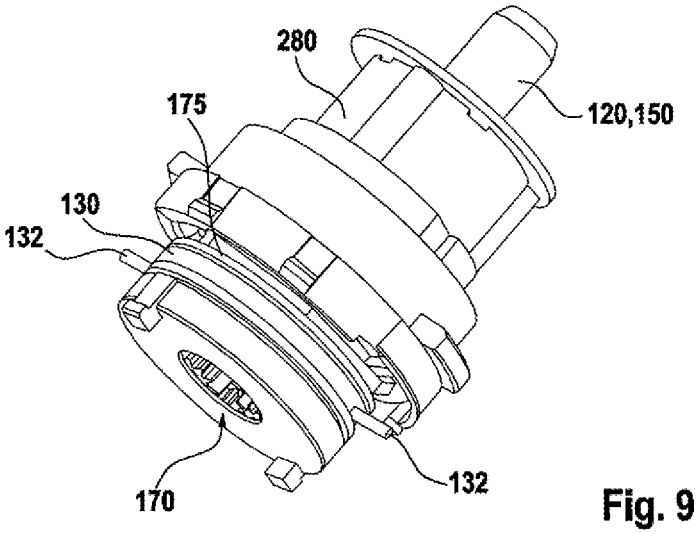
FIG. 9 shows a perspective schematic view of a portion of the setting unit in FIGS. 7 and 8.

As can be seen particularly clearly in FIGS. 3 and 4, two actuators 130 which are arranged so as to be displaceable only in the axial direction of the portable power tool 100 are connected to the housing 110 of the transmission 170 in the illustrated embodiment, wherein each actuator 130 has at least one connecting element 132. The actuators 130 engage in the channels 230 of the adjusting ring 220 via these connecting elements 132. A rotational movement of the adjusting ring 230 in the circumferential direction thus causes no movement of the actuators 130 at all when the connecting elements 132, as illustrated in FIG. 6, are located in the region of the second portions 234 of the channels 230, whereas an axial movement of the actuators 130 is brought about when the adjusting ring 220 is adjusted via the slide switch 202 and the connecting elements 132, as illustrated in FIG. 5, are displaced into the region of the first portion 132.

As can be clearly seen in FIG. 4, the actuators 130 are connected to a ring gear 175 of the transmission 170 via connecting means 134 in such a form-fitting manner that the axial movement of the actuator 130 also causes an axial movement of the ring gear 175. An engagement of the transmission 170 and thus the speed stages can be influenced by the axial movement of the ring gear 175.

A second variant of a setting unit is illustrated in FIGS. 7 to 11, wherein in this second variant, too, an adjusting ring 220 is provided in a manner arranged so as to be displaceable in the radial direction beneath the adjusting element 200 and in the circumferential direction of the housing 110, such that a movement of the adjusting element 200 is transmissible to the adjusting ring 220. In this variant, too, the adjusting ring 200 has at least two channels 230 in the circumferential direction, wherein the channels 230 extend largely in the circumferential direction in this second variant. In this embodiment, the actuator 130, which is arranged so as to be displaceable only in the axial direction of the portable power tool 100, is connected to the housing 110 of the transmission 170, wherein the actuator 130 has more or less the shape of a hoop and engages in a groove in the ring gear 175 in such a form-fitting manner that additional connecting means between the ring gear 175 and the actuator 130 can be dispensed with.

In the illustrated second variant, the actuator 130 has two axially opposite connecting elements 132. By way of these connecting elements 132, the actuator 130 engages in the channels 230 of the adjusting ring 220 such that a rotational movement of the adjusting ring 230 in the circumferential direction also causes a rotational movement of the actuator 130 and thus also a movement of the connecting elements 132 in the channels 230.

Furthermore, the transmission housing 110 has a plurality of first guide means 111 in the circumferential direction, said guide means 111 interacting with a plurality of second guide means 224, distributed in the circumferential direction, of the adjusting ring 220 and a plurality of third guide means 173, distributed in the circumferential direction, of a flange 172, such that a rotational movement of the adjusting ring (220) in the circumferential direction brings about an axial movement of the actuator (130). As can be clearly seen in FIG. 9, the actuator 130 is connected to the ring gear 175 of the transmission 170 via connecting means 134 in such a form-fitting manner that the axial movement of the actuator 130 also causes an axial movement of the ring gear 175. The engagement of the transmission 170 can thus be influenced by the axial movement of the ring gear 175, said engagement again allowing at least two different transmission gears or speed stages.

Figure 10:
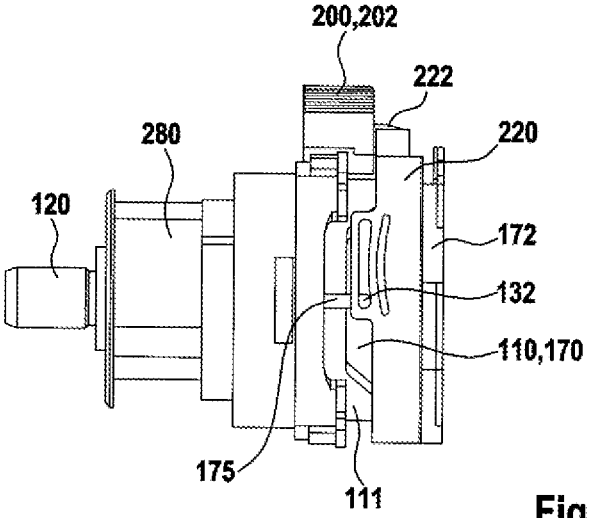
FIG. 10 shows a schematic sectional view of the setting unit from FIGS. 7 to 9 with the adjusting element in a first position.

Thus, FIG. 10 shows the adjusting element 200 in a first position 601, wherein in this first position 601 the first guide means 111 of the transmission housing 110 interact with the second guide means 224 of the adjusting ring 220 such that the second gear in the transmission 170 has been engaged via the actuator 130 and the ring gear 175. In this way, different positions can be set on the portable power tool 100 via the adjusting element 200, said positions each having an optimal basic setting for different applications. Thus, for example this first position 601 can be optimized for "small screws" and thus have a basic setting which comprises the second gear with a high rotational speed and a low torque.

Figure 11:
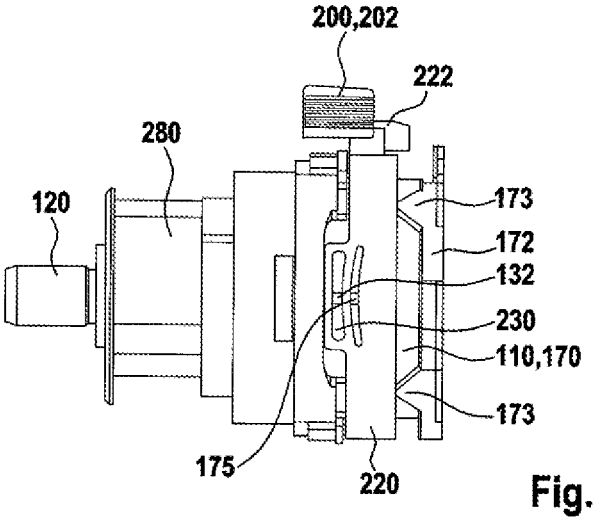
FIG. 11 shows a schematic sectional view of the setting unit from FIGS. 7 to 10 with the adjusting element in a second position.

In FIG. 11, the adjusting element 200 is in a second position 602, wherein the second guide means 224 of the adjusting ring 220 interact with the first guide means 111 of the transmission housing 110 and the third guide means 173 of the flange 172 such that the first gear in the transmission 170 has been engaged via the actuator 130 and the ring gear 175. In this second position 602, for example an optimized basic setting for "large screws", which is exhibited by the first gear having a low rotational speed and a high torque, can be defined.

A further, third position 603 (not illustrated) would be for example "drilling operation". This third position 603 would likewise comprise the second gear having a high rotational speed and a low torque, but in this position a maximum rotational speed and a maximum torque would be automatically specified by the motor control means.

Furthermore, a spring element 300, which holds the slide switch 202 in the different positions, can be provided between the transmission housing 110 and the slide switch 202.

In FIG. 12, it can be seen that beneath the adjusting elements 202, 204 there is provided a circuit board on which at least one first sensor 212 and a second sensor 214 are arranged, said sensors being suitable for sensing the particular position of the adjusting elements 200, 202, 204 and for passing it on to an electronic control element 500 (see FIG. 13). In the illustrated exemplary embodiment, the position of the slide switch 202 and thus the rotary angle position of the adjusting ring 220 are sensed in that the first sensor 212 is embodied as a light barrier. The slide switch 202 also has a switching element 216 which carries out the same relative movement as the slide switch 202 and projects into a sensing range of the sensor 212. Actuation of the slide switch 202 thus causes a relative movement of the switching element 216, the sensor 212 sensing this relative movement and passing on a corresponding signal to the electronic control element 500. Furthermore, the illustrated embodiment has, in addition to the first sensor 212, a further second sensor 214 which senses the position of the second adjusting element 204, a pressure switch.

In principle, it is also possible to use other sensors, for example Hall sensors, potentiometers, pressure sensors and/or other optical sensors, which each have at least one transmitter that emits light beams and a receiver that receives light beams, as optical sensor components for object sensing, or other sensors which are suitable for this purpose, wherein both active and passive sensors can be used. When active sensors are used, it is very advantageously possible to dispense with the provision of a supply voltage for the sensor, such that overall a very simple and cost-effective solution for sensing the position of the adjusting elements 200, 202, 204 is possible. Preferably, sensors that operate on the basis of a piezoelectric effect or by way of electromagnetic induction can be used as active sensors. Alternatively, it is also possible to use passive sensors which, although requiring the provision of a supply voltage, allow changing physical parameters to be sensed very reliably with high precision. Preferably, capacitive, resistive, inductive, galvanomagnetic or optical sensors can be used as passive sensors.

As can be seen in FIGS. 1, 12, and 13, the position, sensed in each case by the sensors 212, 214, of the adjusting elements 200, 202, 204 and the mode of operation, activated by the electronic control element 500, of the portable power tool 100 can be displayed visually to the user by means of a first optical display device 400. Wherein, in principle a binary display, a numeric display or an analog display would be conceivable as the display device 400. In FIG. 12, the first display device 400 shows merely the position of the second adjusting element 204, wherein the display device 400 is embodied by means of a multiplicity of LEDs. What is essential here is that, depending on the display of the first display device 400, the portable power tool 100 is in a corresponding or correlated operating state with different predefined parameters. In addition to the first display device or as an alternative thereto, provision can be made of a second display device 402 which illustrates for example the setting of the motor control means, which in some embodiments is embodied as electronic control element 500, or the set torque. An LED display, which operates with different colors, would be conceivable in this case, such that the setting in which work is currently being carried out is clearly visible to the user.

In addition to the described and depicted embodiments, further embodiments which may comprise further modifications and combinations of features are conceivable.

What is claimed is:

1. A portable power tool, comprising:

a drive motor configured to generate torque;

a transmission including a plurality of transmission gears positioned in a housing, the transmission configured to transmit the torque generated by the drive motor to a drive shaft;

a first adjusting element accessible from outside the housing and configured to set a transmission gear of the plurality of transmission gears;

a first sensor configured to detect a position of the first adjusting element and transmit a first signal corresponding to the position of the first adjusting element to an electronic control element;

a second adjusting element accessible from outside the housing and configured to set the torque;

a second sensor configured to detect a position of the second adjusting element and transmit a second signal corresponding to the position of the second adjusting element to the electronic control element;

an adjusting ring positioned in a radial direction beneath the first adjusting element, and displaceable in a circumferential direction of the housing, wherein the adjusting ring has a channel defined in the circumferential direction; and an actuator connected to the housing and including a connecting element positioned within the channel of the adjusting ring, the actuator configured to be displaceable only in an axial direction of the portable power tool.

2. The portable power tool according to claim 1, wherein the electronic control element is configured to activate a defined operating state of the portable power tool with a combination of predefined parameters depending on the corresponding first signal transmitted by the first sensor.

3. The portable power tool according to claim 2, further comprising an optical display device configured to display the operating state, activated by the electronic control element, of the portable power tool.

4. The portable power tool according to claim 1, wherein the first adjusting element is a switch configured to be directly actuated mechanically.

5. The portable power tool according to claim 4, wherein the switch is configured as at least one of a slide switch, a pressure switch and a switch actuated via sensors.

6. The portable power tool according to claim 1, wherein the first adjusting element is a slide switch configured to be displaced in a circumferential direction of the housing.

7. The portable power tool according to claim 1, wherein the adjusting ring is connected to the first adjusting element via the coupling element such that movement of the first adjusting element is transmitted to the adjusting ring.

8. The portable power tool according to claim 1, wherein the channel includes a first portion extending obliquely to the circumferential direction, and a second portion extending in the circumferential direction.

9. The portable power tool according to claim 8, wherein:

when the connecting element is located in a region of the first portion, rotational movement of the adjusting ring in the circumferential direction moves the actuator axially; and when the connecting element is located in a region of the second portion, rotational movement of the adjusting ring in the circumferential direction does not bring about movement of the actuator in the axial or circumferential directions.

10. The portable power tool according to claim 1, wherein:

the housing includes a first guide element defined in the circumferential direction; and the adjusting ring includes a second guide element defined in the circumferential direction configured to interact with the first guide element such that a rotational movement of the adjusting ring in the circumferential direction brings about an axial movement of the actuator.

11. The portable power tool according to claim 1, wherein:

a ring gear of the plurality of transmission gears is connected to the actuator in a form-fitting manner such that a displacement of the actuator in the axial direction causes an axial movement of the ring gear; and the axial movement of the ring gear causes engagement of the transmission in at least two different speed stages.

12. The portable power tool according to claim 11, wherein the ring gear is connected to the actuator in a form-fitting manner in the axial direction by a connecting element.

13. The portable power tool according to claim 1, further comprising a spring element configured to hold the first adjusting element in different positions.

14. The portable power tool according to claim 1, further comprising an optical display device configured to display the position of the first adjusting element sensed by the first sensor.

15. The portable power tool according to claim 1, wherein the transmission is a planetary transmission.

16. The portable power tool according to claim 1, wherein the second adjusting element comprises a pressure switch.

17. A portable power tool comprising:

a drive motor configured to generate torque;

a transmission including a plurality of transmission gears positioned in a housing, the transmission configured to transmit the torque generated by the drive motor to a drive shaft;

a first adjusting element accessible from outside the housing and configured to set a transmission gear of the plurality of transmission gears;

a first sensor configured to detect a position of the first adjusting element and transmit a first signal corresponding to the position of the first adjusting element to an electronic control element;

a second adjusting element accessible from outside the housing and configured to set the torque;

a second sensor configured to detect a position of the second adjusting element and transmit a second signal corresponding to the position of the second adjusting element to the electronic control element;

an adjusting ring configured to be displaceable in a radial direction beneath the first adjusting element, and in a circumferential direction of the housing; and an actuator connected to the housing and including a connecting element positioned within the channel of the adjusting ring, the actuator configured to be displaceable only in an axial direction of the portable power tool, wherein the adjusting ring is connected to the first adjusting element via a coupling element such that movement of the first adjusting element is transmitted to the adjusting ring, and wherein the adjusting ring has a channel defined in the circumferential direction.

* * * * *